United States Patent [19]

Hausfeld

[11] 4,160,191

[45] Jul. 3, 1979

[54] SELF-SUSTAINING PLASMA DISCHARGE DISPLAY DEVICE

[76] Inventor: A. David Hausfeld, 1833 S. Ocean Dr., Hallandale, Fla. 33009

[21] Appl. No.: 864,259

[22] Filed: Dec. 27, 1977

[51] Int. Cl.[2] ..... H05B 37/00; H05B 39/00; H05B 41/00

[52] U.S. Cl. ..... 315/169.4; 313/194; 313/200; 313/491; 340/772

[58] Field of Search ..... 315/169 R, 169 TV; 340/324 M; 313/194, 199, 200, 484, 491

[56] References Cited

U.S. PATENT DOCUMENTS 3,622,829 11/1971 Watanabe ..... 313/491

3,899,636 8/1975 Chodil et al. ..... 313/185 X

*Primary Examiner*—Alfred E. Smith
*Assistant Examiner*—Robert E. Wise
*Attorney, Agent, or Firm*—Schiller & Pandiscio

[57] ABSTRACT

An improved display device of the Type using a self-sustained discharge as a source of electrons for cathodoluminescence is operable at relatively greater pressures so as to lower the necessary striking potential to the Paschen minimum and includes an improved grid structure for selectively controlling the transport of electrons from the sustained discharge to a high voltage screen, and constructed so as to limit positive ion space charge formation therebetween.

50 Claims, 17 Drawing Figures

SELF-SUSTAINING PLASMA DISCHARGE DISPLAY DEVICE

This invention relates to display devices and more particularly to gas discharge panels suitable for displaying alphanumerics, TV images and the like.

With the widespread use of the cathode ray tube, a great deal of investigation has been and is still being made into the development of technically, as well as commercially feasible, flat panel display devices capable of displaying TV images as well as alphanumerics. More particularly, since cathode ray tubes each typically include an electron gun for generating and deflecting the beam towards a cathodoluminescent screen, the tubes are generally relatively large in their depth dimension and as a consequence are relatively heavy and cumbersome.

Accordingly, flat gas discharge display panel devices have received a great deal of attention. For example, see U.S. Pat. Nos. 3,904,923 (to Schwartz) 3,899,636 (to Chodil et al) and 3,622,829 (to Watanabe), and the references cited therein; Krupka et al, "On the Use of Phosphors Excited by Low-Energy Electrons in a Gas-Discharge Flat-Panel Display", *Proceedings of the IEEE,* Vol. 61 pp. 1025–1029, No. 7, July 1973; Chodil et al "Good Quality TV Pictures Using a Gas-Discharge Panel", *IEEE Transactions on Electron Devices,* Vol. ED-20, No. 11, pp. 1098–1102 November 1973; and Amano, "A Flat-Panel TV Display System in Monochrome and Color", *IEEE Transactions on Electron Devices,* Vol. ED-22 No. 1, pp. 1–7, January, 1975.

In a gas discharge device such as that disclosed by Watanabe a sustained gas discharge or plasma serves as a source of electrons for excitation of a cathodoluminescent high voltage screen. To provide a sustained discharge several variables have to be considered: (1) The configuration of at least two electrodes required for the discharge whose principal characteristic is the distance therebetween; (2) The material of the electrodes; (3) The potential difference applied between the electrodes; (4) The kind of gas disposed between the electrodes; and (5) The pressure of the gas. For a given kind of gas at a given pressure, and a given electrode configuration of a given electrode material, a certain potential difference applied across the electrodes will result in a sustained discharge. For an electrode configuration providing two substantially parallel planar electrodes of width and height dimensions substantially larger than the distance therebetween, there exists a relationship known as Paschen's law which states that the potential at which the sustained discharge ensues (hereinafter known as the "striking potential") is a function of the product "pd" of pressure p and electrode spacing d. The application of Paschen's law to the operation of the devices of the Watanabe type is described in U.S. Pat. No. 3,622,829 and is further elaborated hereinafter. Generally, for any given kind of gas and electrode material there exists a unique value of the product pd at which a minimum striking potential can be applied to provide a self-sustained discharge. This minimum striking voltage is referred to as the Paschen minimum potential (hereinafter known as the "Paschen minimum").

Broadly, it is preferred to operate devices of the Watanabe type such that the sustained discharge occurs at the Paschen minimum. This condition provides convenient operating voltages and reduced power consumption. However, for reasons which will be elaborated hereinafter, prior to the present invention, optimum device parameters were such that the Paschen minimum was not easily obtainable. This is due to the fact that the sustained discharge is maintained as a ready supply of electrons for acceleration to a high potential cathodoluminescent screen. Consequently, problems arising from the collisions of the electrons with gas molecules during acceleration, and particularly the formation of positive ions, necessitate keeping the pressure sufficiently low in order to provide a relatively long electron means free path length so as to avoid excessive collisions.

More particularly, the construction of the Watanabe device is such that a sustained gas discharge functions to provide a source of electrons which can be selectively and controllably accelerated to various parts of the high voltage screen.

In order to control the flow of electrons from the self-sustained gas discharge to the high voltage screen, the panel includes a control grid electrode. The latter includes an electrically-insulating substrate provided with a rectangular array of apertures and electrically-conductive grid control elements disposed on both sides of the substrate so as to define an X-Y control grid array. The grid array essentially functions as an addressing means so that current may selectively be provided to individual image elements or segments of the screen. Specifically, grid control elements (the X elements) on one side of the substrate are oriented in a parallel, spaced-apart, relationship with respect to one another, while the control elements (the Y elements) on the other side are oriented in parallel, spaced-apart, relationship with respect to each other and generally orthogonal to the X elements. The control grid electrode is positioned between the plasma discharge and the high voltage screen, with the amount of current accelerated from the plasma through a particular aperture of the grid control element to a particular part of the target controlled by the potentials provided on the particular X and Y grid control elements corresponding to the aperture. Thus, the grid control elements function to shield the high voltage screen from the gas discharge, while allowing electrons to be controllably and selectively transported through each aperture of the grid electrode. Of importance is that the path length (hereinafter referred to as the "acceleration path length") of the electrons accelerated from the sustained discharge to the high voltage screen through the control grid apertures must be substantially less than the electron mean free path length otherwise positive ion formation and consequent space charge formation may result in a failure of the control grid to effectively shield the sustained discharge from the high voltage screen.

In view of the foregoing the prior art thin gas discharge display panels such as the one described by Watanabe, are accordingly operated at very low gas pressures, for example, $10^{-2}$ torr where difficulties are encountered in providing a sustained gas discharge at or near the Paschen minimum. It is believed that because of these difficulties Watanabe positions the cathode and anode (electrodes sustaining the discharge) at opposite edges of the panel so that the discharge occurs across the entire width of the panel, a structure which is believed as a practical matter to limit the maximum area of the panel. It is also believed that these difficulties necessitate the introduction of a thermionic cathode as one of the electrodes sustaining the discharge. Although Watanabe describes the desirability of operating the sustained gas discharge at the Paschen minimum it is submitted he is in fact unable to do so without the use of a thermionic cathode (a cathode which must be heated and therefore consumes a relatively large amount of power) at the low pressures that he requires in his device to avoid the problems associated with positive ion formation.

It would appear therefore clearly advantageous to substantially increase the pressure in the Watanabe device to easily achieve the sustained discharge at the Paschen minimum without the need for a thermionic cathode. For example, an increase in pressure from $10^{-2}$ torr to 1 torr would decrease the required striking voltage. As previously noted, however, the difficulties associated with positive ion formation must be considered. Substantially higher pressures result in shorter electron means free path lengths with respect to the acceleration path length and consequently positive ion space charge formation results in and about the control grid apertures. This space charge sheath tends to shield the entrance and interior of the aperture from the control potential impressed on the control grid which leads to uncontrollable operation. Although Watanabe suggests extending a portion of each grid electrode element partially into the corresponding grid aperture, in order to improve the control of the electron flow by reducing surface charge caused by electrons adhering to the surface of the insulating substrate, he finds it necessary to operate at a pressure well below the pressure required to readily operate at the Paschen minimum, so as to maintain the electron mean free path length much greater than the electron acceleration path length, a necessity probably prompted in part by the limitations posed by his particular grid structure where sufficiently untoward positive ion sheathing can still occur.

It is therefore a general object of the present invention to provide an improved plasma discharge device.

Another more specific object of the present invention is to provide an improved flat plasma discharge panel device useful for TV as well as alhpanumeric, displays and operable at the Paschen minimum at relatively low levels of power consumption.

Still another object of the present invention is to provide an improved plasma discharge display device having a source of electrons from a self-sustained gas discharge operable at the Paschen minimum while providing selectively controllable shielding means between the source of electrons and each picture element or segment of the cathodoluminescent high voltage screen.

Yet another object of the present invention is to provide a plasma discharge display panel suitable for alphanumeric displays, TV displays and the like, which is relatively thin (in the order of 1.25 cm) and of a relatively large area (in the order of one meter square).

And still another object of the present invention is to provide plasma discharge display devices including improved and relatively less costly means for addressing each individual image element.

These and other objects of the present invention are achieved by an improved plasma discharge display assembly comprising a sealed enclosure; gas disposed in the enclosure at a predetermined pressure P; cathode means disposed within the enclosure for providing electrons to sustain a discharge; and cathodoluminescent target means, disposed within the enclosure and spaced from the cathode means for generating light in response to electrons provided by the sustained discharge and striking the target means. An improved electrode means is disposed between the cathode means and target means and includes at least one passageway for conducting electrons between the sustained discharge and the target means. The electrode means further includes anode means disposed at a distance d from said cathode means for maintaining a self sustained discharge from said cathode means to said anode and control means for controlling the conduction of electrons through the passageway. The pressure P and distance d are such that the product Pd is that product where a selfsustained plasma discharge occurs between the cathode means and the anode means when the electrical potential between the cathode means and anode means is substantially equal to the Paschen minimum of the gas, and the acceleration path length through the passageway is such that at pressure P substantial positive ion space charge formation occurs within the passageway. Accordingly, the electrode means also includes means for limiting positive ion sheathing in the passageway between the sustained discharge and the target means. Preferably, the means for limiting positive ion sheathing includes a portion of the passageway made relatively long and narrow and including surfaces that are electrically conducting and means for applying a relative potential on the electrically conductive surfaces below the potential of that of the target means. Other means for limiting positive ion sheathing are disclosed hereinafter.

Other objects of the invention will in part be obvious and will in part appear hereinater. The invention accordingly comprises the apparatus possessing the construction, combination of elements and arrangement of parts which are exemplified in the following detailed disclosure, and the scope of the application of which will be indicated in the claims.

For a further understanding of the nature and objects of the present invention, reference should be had to the following detailed description taken in connection with the accompanying drawings wherein:

FIG. 1 is a partial, cross-sectional view of a prior art plasma display device of the type described in U.S. Pat. No. 3,622,829;

FIG. 2 is a graphical illustration of Paschen's law;

FIGS. 3–6 are graphical illustrations of the effects of positive ion space charge formation on control grid structures of the type described in U.S. Pat. No 3,622,829;

Figure 1:
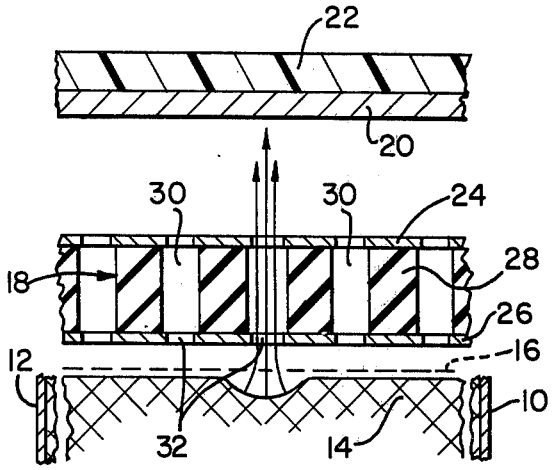
FIG. 1 PRIOR ART

Referring to FIG. 1, the prior art plasma discharge display panel shown is of the type described in U.S. Pat.

Figure 2:
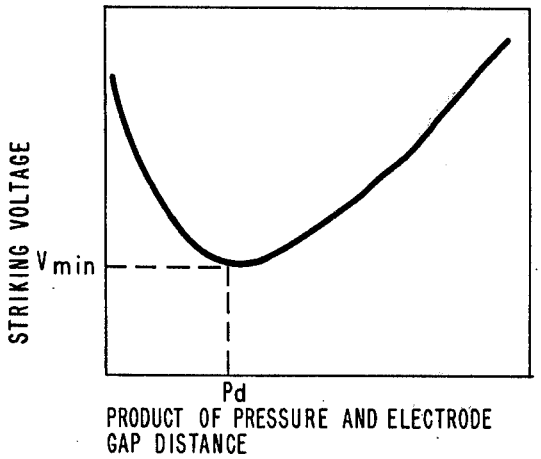

No. 3,622,829. The device generally includes anode 10 and cathode 12 at opposite edges of the panel for providing the gas discharge 14; subsidiary electrode 16; control grid 18 and high voltage accelerating anode or cathodoluminescent screen or target 20 disposed on the transparent plate 22. Control grid 18 comprises a first set of control elements 24 on one side of the electrically-insulative substrate 28 and a second set of grid control elements 26 on the other side of the substrate. Both sets of grid control elements are formed by arranging a plurality of metal electrode elongated narrow sheets in parallel with each other. The direction of the sheets of the second set of elements 26 (perpendicular to the plane shown in FIG. 1) is orthogonal to that of the first set of elements 24 (parallel to the plane shown in FIG. 1). At the apparent location where each of the metal electrode sheets of elements 24 intersect the elements 26, small holes or apertures 30, penetrating through the elements and the insulating substrate 28 are provided. In order to provide a self sustained discharge 14 between cathode 12 and anode 10, the potential difference between the two must be equal to the striking potential which as shown in FIG. 2 has a relationship with the product Pd. As shown in the table of column 5 of the Watanabe patent the specific value of the Paschen minimum, Vmin, and related value of the product Pd is dependent, in part, on the gas employed in the tube. For example, for helium, Vmin = 147 volt and Pd = 35 mm-Hg-mm; for neon, Vmin = 168 volts and Pd = 38 mm-Hg-mm; for argon Vmin = 192 volts and pd = 12 mm-Hg-mm, etc. Watanabe states that the gas pressure P and the cathode-anode spacing are determined so as to insure the Paschen minimum, and that the high voltage accelerating anode or screen 20, control electrode 18 and subsidiary electrode 16 are arranged very close together without causing electrical discharge therebetween even if a large potential difference is provided therebetween. However, it is doubtful that such could be achieved with the structure described by Watanabe and, in fact, explains why Watanabe describes in his example of the case of argon gas, a gas pressure of $10^{-2}$ mm-Hg and discharge path distance of 100 mm to provide a product of 1 mm-Hg-mm, well below the required 12 mm-Hg-mm. It is therefore necessary to either operate the Watanabe device at a striking voltage above Vmin or to use a thermionic cathode for cathode 12. The use of such a thermionic cathode increases the operating power consumption and device complexity.

More specifically, utilizing the structure described by Watanabe at operating pressure in the order of $10^{-2}$ torr as he suggests, the electron mean free path length is in the order of 2.5 cm. It is clear that the dimensions of the Watanabe panel can be made so that the distance between subsidiary electrode 16 through each aperture 30 to screen 20 can be made considerably less than 2.5 cm. Thus, as suggested by Watanabe a large portion of the electrons can pass through each aperture 30 to screen 20 to excite the phosphor. There are essentially no collisions of electrons with gas molecules within or above the grid apertures so that few electrons are lost by scattering and absorption in the interior of aperture 30.

As there are essentially no collisions of electrons with gas molecules there is essentially no positive ion space charge formation in or above grid apertures 30. A direct consequence of this lack of space charge formation is that the potential at a point in space at the entrance 32 of an aperture 30 is essentially the same as the potential impressed on the electrode sheet of electrode 26 surrounding entrance 32 to aperture 30. This is true for nominal currents passing through a grid aperture. Should exceedingly high currents be made to pass through an aperture, some small positive ion space charge will result with concomitant variation in potential at the entrance.

Increasing the operating pressure to an order of 1 torr, with an electron mean free path length of an order of 0.025 cm, without making adjustments to the subsidiary electrode 16, the control grid electrode 18, and adjustments to the relationship therebetween and to their relationships with respect to high voltage screen 20, presents several problems. Firstly, as the dimensions of grid apertures are now of the order of an electron mean free path (for easily manufacturable structures), many electrons entering aperture 30 will collide with a gas molecule and scatter to the walls of the aperture 30 seemingly inhibiting transport of electrons therethrough. Secondly, as electron collisions with gas molecules predominate in and above the aperture, large positive ion space charge formation is expected with the aperture at nominal current levels. This will significantly raise the potential at a point in space near entrance 32 of aperture 30 relative to the potential impressed on the sheets of the elements 24 and 26 defining the particular aperture. This space charge effect could result in a failure of the grid structure 18 to effectively shield the high voltage anode screen 20 from the sustained gas discharge 14, the consequence of which is uncontrollable operation.

Since this is very undesirable it is important to understand how positive ion space charge leads to uncontrollability, and how the present invention counteracts this effect while still allowing electrons to be transported controllably through a control grid electrode.

Figure 7:
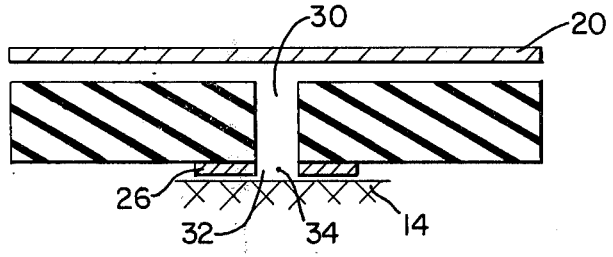
FIG. 7 PRIOR ART
FIG. 7 is a simplified, partial cross-sectional view of the prior art display device.

Referring to FIG. 7 simplifying the Watanabe structure for ease of exposition, consider only one grid aperture 30 situated between a high voltage acceleration anode 20 and a sustained gas discharge 14.

Assume that only one grid control element 26 surrounding the entrance 32 to the grid aperture 30 is necesary to control current through the aperture and that the control element is positive with respect to gas discharge plasma 14 so that an electron current flows to this electrode and some electrons enter the aperture. For effective control it is desirable that the electron current reaching the high voltage anode 20 be controllable by varying conditions at the grid aperture entrance 32 or, more specifically, the potential on the grid control element 26 surrounding the aperture entrance 32, while the high voltage anode 20 is essentially held at a fixed potential irrespective of current drawn to it. This feature allows the high voltage anode for the display to be a single continuous conductive sheet held at a fixed high voltage.

The possibility of achieving this kind of behavior may be explored by considering what follows. Call the potential on the grid electrode 26 surrounding the entrance 32, $V_o$; call the potential at a point 34 on a hypothetical surface over the aperture entrance 32, V. Using well known probe theory (see for example Cobine, James Dillon; Gaseous Conductors, Theory and Engineering Applications; Dover Publications, Inc., New York, 1958), P. 134), point 34, with potential V, may be considered as a probe electrode independent of the grid electrode 26. Should a positive ion space charge form in and about the grid aperture, potential V would increase with respect potential $V_o$. Probe theory then suggests that, should the potential V increase with respect to potential $V_o$, electron current drawn into aperture 30 would increase. As the electron current passing through the grid aperture increases the collisions between electrons and gas molecules increases so as to increase positive ion space charge formation. This situation may be further understood by referring to FIGS. 3–6, where $\delta V = V - V_0$, and i is equal to the electron current passing into grid aperture 30 at entrance 32. Considering point 34 as a probe with respect to the sustained gas discharge plasma about the entrance to the aperture the functional relationship (hereinafter referred to as the "probe function"), between $\delta V$ and i is believed to appear qualitatively as a function similar to that shown in FIG. 3.

It is noted that at $\delta V = o$, or $V = Vo$, i has a finite value a consequence of $V_o$ being more positive than or equal to the potential of the ambient plasma.

If $\delta V$ is considered to vary as a consequence of positive ion space charge formation which increases with increasing i, this functional relationship, (hereinafter referred to as the "space charge function") is believed to qualitatively appear as a function similar to that shown in FIG. 4. The probe function and the space charge function are different functional relationships between the same two variables.

Figure 3:
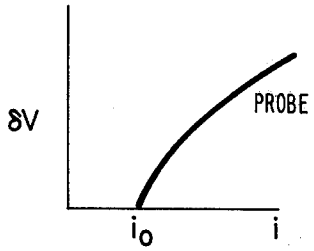
Figure 4:
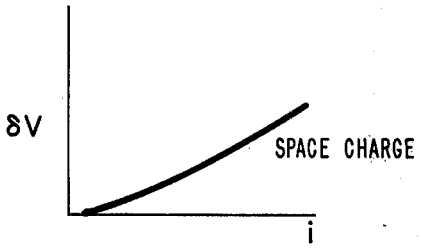

It is obvious that in any mode of operation the probe function of FIG. 3 and the space charge function of FIG. 4 must have a common set of values or a common point of intersection. For a given configuration of the device, varying the potential $V_o$ impressed on grid control element 26 of FIG. 7, will vary the form of the probe function of FIG. 3. For example, increasing $V_o$ will generally shift the probe function (as shown in FIG. 3) to the right, while decreasing $V_o$ will generally shift it to the left. This procedure will generally have little effect on the space charge function of FIG. 4 as positive ion formation occurs within and above the aperture. Varying $V_o$ may then provide a desirable means to control device operation.

Figure 5:
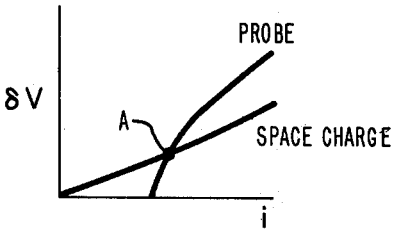
Figure 6:
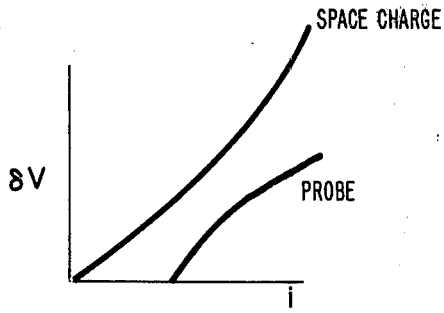

Formally, stability criteria must be satisfied by a common point A of intersection of the probe function and space charge function if controllability independent of the high voltage anode potential is desired. That is if i arbitrarily fluctuates, conditions within the device must be such that i is forced to return to its operating, or stable, value. For example, a probe function for a particular value of $V_o$, and a space charge function are plotted in FIG. 5. As readily seen from this FIG. 5 is the value of i should arbitrarily increase by some small amount from operating point A, the increase in potential V as a consequence of the increment in current attributed to positive ion space charge formation (as given by the space charge function) is insufficient to maintain the increased current by drawing as a probe more current from the gas discharge plasma (as given by the probe function). Conversely, should the value of i arbitrarily decrease by some small amount, V at the decreased value of i (as given by the space charge function) is more than adequate to restore i to its operating value at point A. Thus, an operating point will be stable if at that point the slope of the probe function is greater than the slope of the space charge function. It is also necessary that the value of $\delta V$ for the space charge function be greater than $\delta V$ for the probe function for all values of i less than the value of i at the operating point. This insures that there are no stable operating points at current values lower than is desired, and natural access to the desired operating point exists.

One can forsee instances in which the space charge function never intersects the probe function. (See FIG. 6) If high voltage anode 20 is in place such that the potential of anode is held at a fixed high voltage with respect to the sustained gas discharge plasma independent of electron current being drawn to the high voltage anode, nonintersection of the probe function with the space charge function could in principle result in an infinite electron current to high voltage anode 20. This is the nature of the uncontrollability discussed above.

In accordance with the present invention, an improved panel display device of the type incorporating a sustained discharge as a source of electrons for cathodoluminescense, is provided in which the operating pressure P is increased relative to those operating pressures used by Watanabe in order to operate the device with a striking potential substantially at the Paschen minimum. The device includes electron transport means for selectively controlling the transport of electrons from the self-sustained gas discharge to the high voltage anode. The electron transport means includes means for limiting positive ion space charge formation so as to effect stable controllable device operation.

Figure 8:
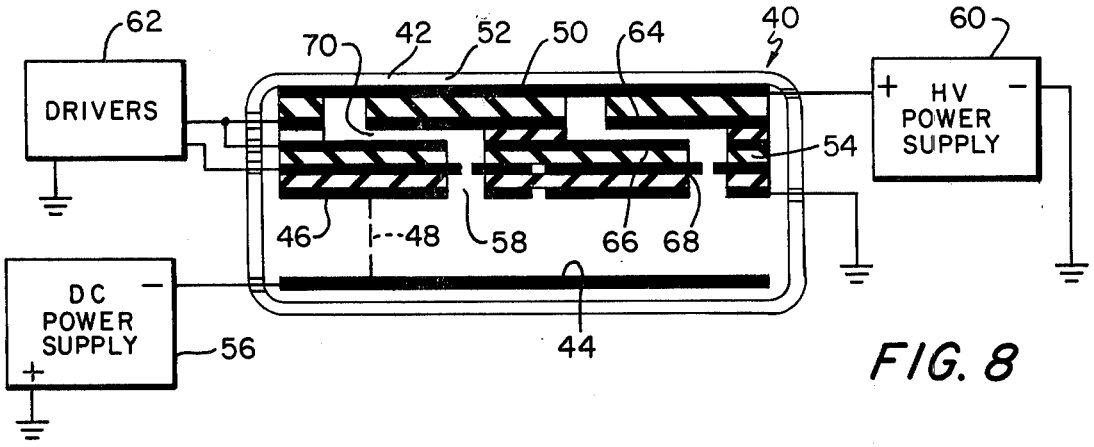
FIG. 8 is partially a cross-sectional view and partially a block diagram of the preferred embodiment of the present invention.

More specifically, referring to FIG. 8 the panel device 40 includes a housing or enclosure 42, cathode means 44 and anode means 46 for providing the sustained gas discharge 48 therebetween and cathodoluminescent target means 50 for providing an image display on face plate 52 when electrons drawn from the sustained discharge strike the target means. Grid control means 54, disposed between the sustained discharge and the target means 50, is used to selectively shield each of a plurality of segments of the target means from the sustained discharge. The enclosure is filled with an inert gas, such as argon or other suitable material, at an operating pressure P. The cahode means 44 and anode means 46 are spaced a distance d and are constructed so that the discharge may occur at or near the Paschen minimum. More specifically, the cathode means and anode means 46 are spaced a distance d and are constructed such that the discharge occurs in a direction substantially perpendicular to the target means 50. The values of P and d are such that when the cathode means 44 and anode means 46 are connected to a suitable power supply 56 set or near the Paschen minimum, sustained discharge 48 will occur between the cathode means and anode means.

Grid control means 54 is spaced from target means 50 such that the associated value at pd is sufficiently below that of the Paschen minimum so as not to have a sustained discharge therebetween when a high potential difference is applied therebetween. Also grid control means 54 is spaced from target means 50 such that cold field emission of electrons from the grid will not occur when a high potential difference is applied therebetween. The grid control means 54 preferably is provided with a plurality of passageways 58, each for transporting electrons from the sustained discharge 48 on one side of grid control means 54 to a corresponding segment of the cathodoluminescent target means 50 when a sufficiently high voltage (e.g. 2000 volts) is provided by the high voltage power supply 60 on the target means 50. The grid control means further includes means associated with each passageway, including electrode structures 64, 66 and 68 and driving means 62 for selectively applying suitable potentials to electrode structures 64, 66 and 68 so as to effect selective and controllable electron transport from sustained discharge 48 to the cathodoluminescent target means 50, and for substantially limiting positive ion space charge formation so as to effect stable controllable operation.

More specifically, since the pressure P is at a substantially higher operating level than the prior art devices of the type described, the question of stable operation must be considered. Accordingly, referring again to FIGS. 3–6 an approach to stable operation may be had by lowering the slope of the space charge function in FIG. 6 so as to allow intersection with the associated probe function. This is tantamount to reducing positive ion space charge formation principally about the entrance to the grid passageway. Generally, the preferred technique is to provide at least a portion 70 of passageway 58 that is substantially long and narrow, and includes inner surfaces that are electrically conducting and held at a potential substantially less than that impressed on target means 50. (In the embodiment shown these surfaces are defined by electrode structures 64 and 66). The resultant proximity of the conductive surfaces to the space within the passageway portion 70 tends to readily neutralize positive ions in the space defined by the portion. This resulting proximity of these conductive surfaces within the passageway portion would also seem to inhibit the successful transport of electrons through the passageway. I have found, however, that acceptable levels of electrons are, transported through such a passageway portion, and it is believed that this is due, in part, to serendipitous effects associated with the presence of positive ion and associated space charge. Absorption and reemission of electrons from conductive surfaces within and about the passageway portion, as well as electrons released by the ionizing collisions may also contribute to successful electron transport. Of importance is the fact that the path of electrons through each passageway need not follow a straight line, as is believed required in the prior art devices.

Figure 9:
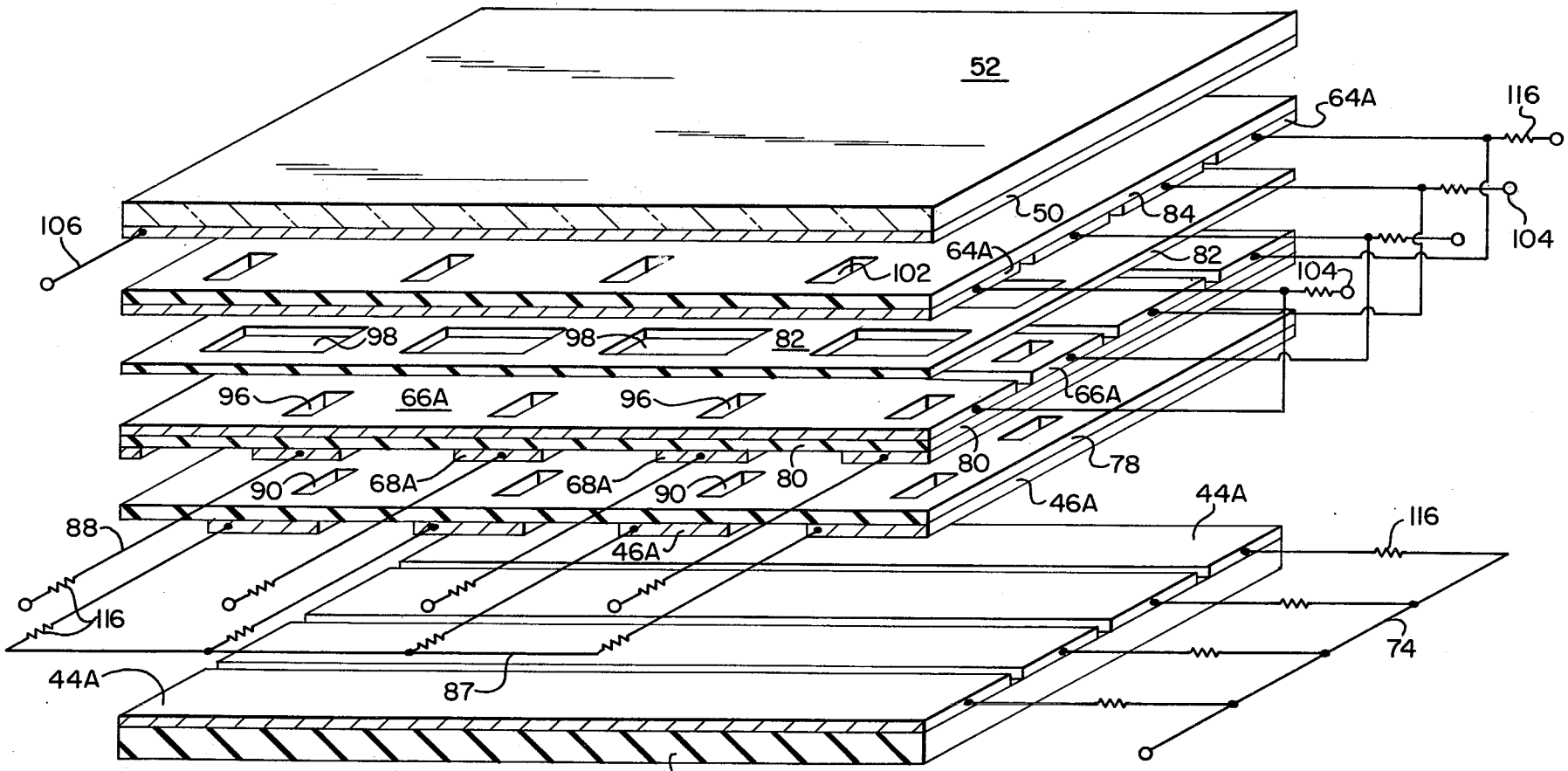
FIG. 9 is an exploded perspective view of a section of the embodiment of FIG. 8.
Figure 10:
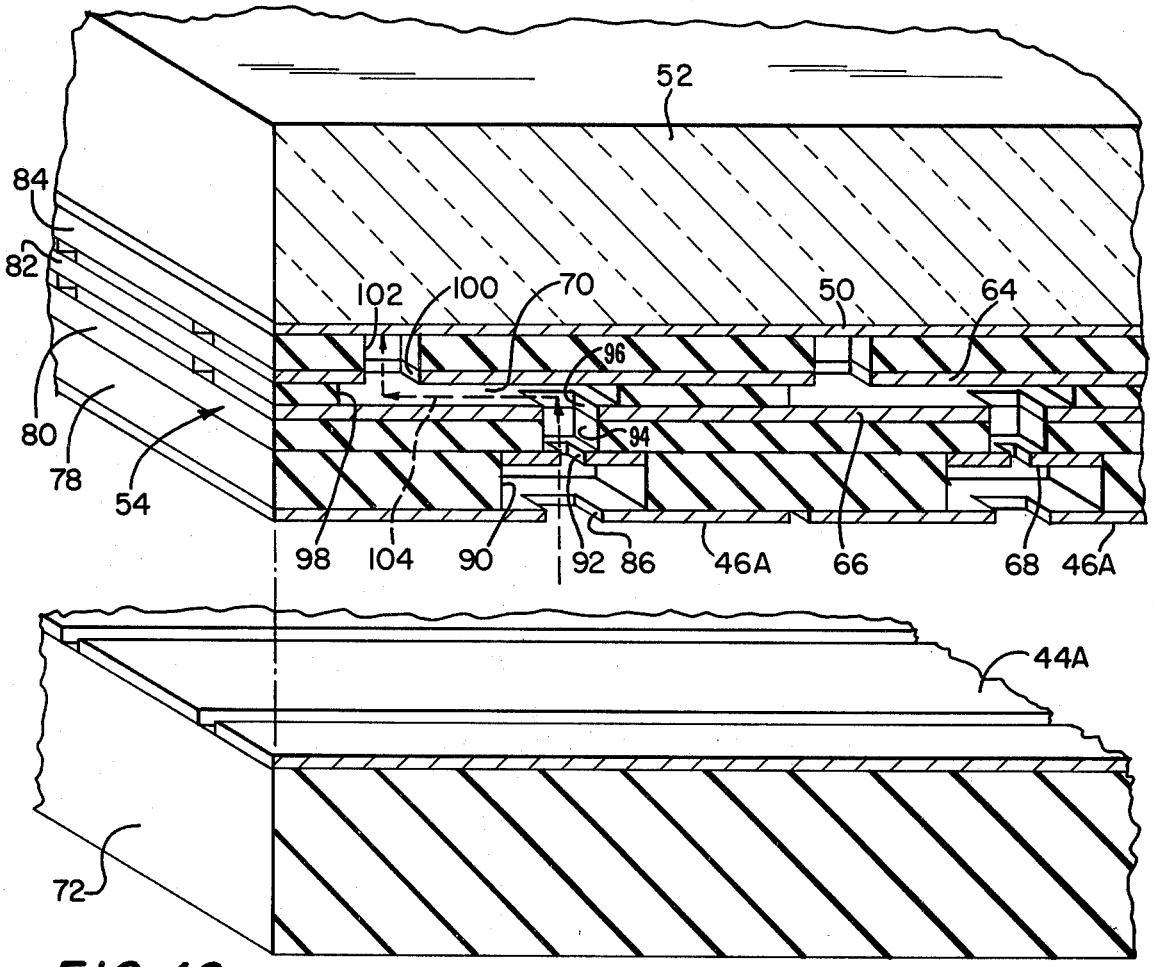
FIG. 10 is a perspective view of the embodiment of FIG. 8.
Figure 11:
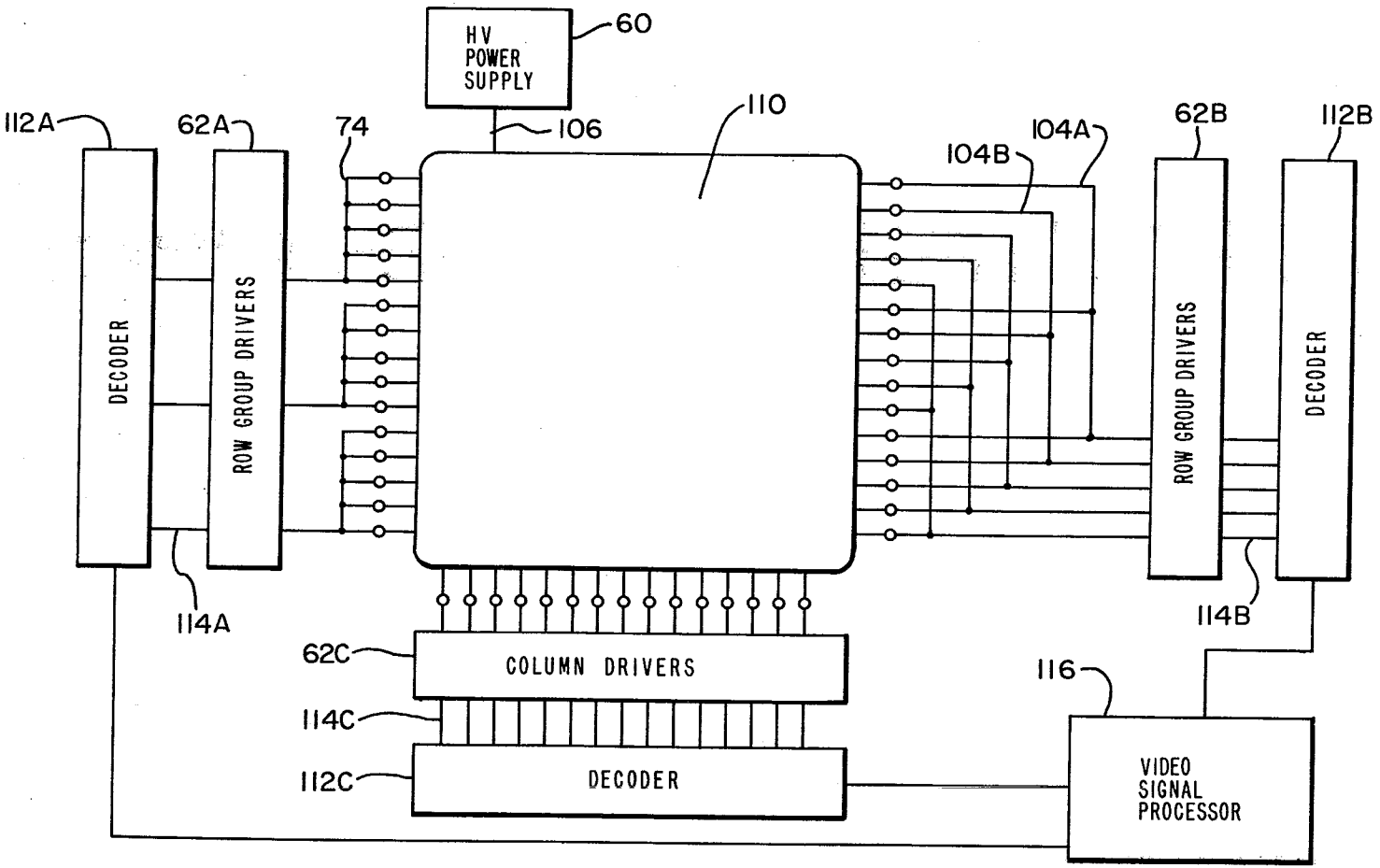
FIG. 11 is a schematic diagram of the preferred addressing system utilized in the present invention.

Referring to FIGS. 9–11, the preferred embodiment is shown which incorporates the positive ion space charge and suitable limiting means described with respect to FIG. 8. In particular, the device includes cathode means in the form of a plurality of coplanar parallel equally-spaced-apart conductive strips 44A (each strip corresponding to a row of the display array) extending the entire width of the display device and disposed on the upper surface of an electrically-insulative sheet 72 which may serve as the back wall of the device envelope. As will be more evident hereinafter strips 44A are approximately connected in groups, each of equal number, e.g. five per group, with the strips of each group connected to a common line 74, which in turn is connected to an appropriate row group driver or drivers 62A, (shown in FIG. 11).

The anode means 46, grid control means 54, target means 50 and face plate 52 are preferably arranged with intermediate electrically-insulative spacer sheets 78, 80, 82 and 84 as a laminated assembly. More particularly, the anode means preferably includes a plurality of coplanar, parallel, equally spaced apart electrically-conductive strips 46A extending the entire height of the panel and disposed on the lower surface of an electrically-insulative sheet 78, each strip 46A corresponding to a column of the display array. Viewing both anode strips 46A and cathod strips 44A from the plane in which strips 46A lie, the strips 46A are oriented in a perpendicular direction to strips 44A, and where each strip 46A intersects a strip 44A, the strip 46A is provided with an aperture 86, preferably square in cross-section which forms the entrance of the passageway 58. Anode strips 46A are connected together to common line 87 which in turn is grounded. The sheet 78 is provided with a plurality of apertures 90 each one of which is dimensioned to be slightly larger in cross-section and coaxial with a corresponding aperture 86 of the anode strip.

The electrode structure 68 is disposed between sheet 80 and 78, electrode structure 66 is disposed between sheet 80 and 82, electrode structure 64 is disposed between sheets 82 and 84 and target means 50 is disposed between sheet 84 and face plate 52. (The latter may be the front of the device envelope). Electrode structure 68 preferably includes a plurality of coplanar, parallel, spaced-apart strips 68A, (one for each column of the array) each extending the entire height of the panel and generally parallel with a corresponding anode strip 46A on the opposite side of sheet 78, while the electrode structure 66 preferably includes a plurality of coplanar, parallel spaced-apart strips 66A (one for each row of the array) each extending the entire width of the panel and generally parallel with a corresponding cathode strip 44A. An aperture 92 of smaller cross-sectional dimensions than either aperture 86 or 90 is provided in the electrode strips 68A and positioned coaxially with each aperture 86 and 90. Similarly, sheets 80 and the strips 66A are provided with respective apertures 94 and 96, each being dimensioned approximately with the same cross-sectional dimensions as apertures 86 and each coaxially disposed with respect to a corresponding aperture 92 as well as to each other.

Sheet 82 includes an array of rectangular apertures 98, one for each set of apertures 86, 90, 92, 94 and 96. Each aperture 98 has a cross-sectional width slighly larger than and a length substantially larger than aperture 96 so as to form the passageway portion 70 with the aperture 96 at one end of the passageway portion. Electrode structure 64 preferably includes a plurality of coplanar, parallel, spaced apart strips 64A, (one for each row of the array) each extending generally parallel with a corresponding strip 66A. Each strip 64A and the overlying electrically-insulative sheet 84 is provided with a plurality of apertures 100 and 102, respectively, each aperture 100 being coaxial with an aperture 102, and both being offset from the axis of apertures 90, 92, 94 and 96 at the opposite end of the passageway portion 70. Each aperture 102 of sheet 84 exposes a segment of the high voltage target means.

Although not shown in detail, target means 50 includes a sheet of cathodoluminescent material, (preferably a continuous sheet of fine conductive wire mesh serves as the high voltage anode which is interposed between a sheet of suitable cathodoluminescent material on face plate 52 and insulating sheet 84). When the high voltage anode is set at the high voltage setting of power supply 60 through line 106, it will cause acceleration of electrons through the passageway (when the electrodes are properly addressed), which then strike the particular segment, of cathodoluminescent material where photons will be generated in accordance with well known cathodoluminescence phenomena.

The apertures 86, 90, 92, 94, 96, 98, 100 and 102 thus define the passageway through which electrons travel along an offsetting path as generally indicated by the dotted arrows 104 shown in FIG. 10, to the particular segment of anode 50.

Each strip 68A is connected through each line 88 to the individual column drivers 62C. (See FIG. 11) The strips 64A and 66A of each row are connected together on line 10, which in turn is connected to the row drivers 62B in a manner described hereinafter.

In operation a gas discharge is maintained between the appropriate anode and cathode strips 44A and 46A when a particular segment of high voltage anode is to be exposed to electron beam; the electrons first pass along line 104, through apertures 86, 90, 92, 94 and 96. Accordingly in order to control the current passing through these apertures, a suitable potential is impressed on the electrode strip 68A corresponding to the column to which the particular segment to be exposed belongs. Similarly, preferably although not necessarily the same potential $V_o$ is impressed on both the strips 66A and 64A corresponding to the row to which the particular segment to be exposed belongs. The dimensions of each aperture 92, the thickness of sheet 80, and the thickness of strips 68A when taken in connection with the sustained discharge between cathode and anode strips 44A and 46A and the potential $V_o$ impressed on strips 66A and 64A, are such that said control can be effected. The nature of the control afforded by the strips 68A are similar to that afforded by thyratron grids typically found in thyratron tubes. (For example see Cobine, supra, pp 434 and 452 and U.S. Pat. No. 2,512,538 issued to Baker on June 20, 1950). The several modes of control of thyratron tubes are equally applicable in the present invention. For example, positive grid control, negative grid control or continuous grid control can be utilized to provide electron flow through apertures 86, 90, 92, 94 and 96.

Control of electron transport to the entrance of the passageway portion 70 is thus controlled by strips 64A, 66A and 68A, where the portion of strips 64A exposed through aperture 96 serves as an electrode at the entrance of the portion 70 at the potential $V_o$, thereby controlling ambient current density. This control technique is preferred since the events occuring in one passageway will not influence those occurring in other passageways so as to interfere with stable controllable operation.

Although the acceleration path length along dotted line 104 is in the order of the electron mean free path, the presence of electrode strips 64A and 66A in the passageway portion 70 at the potential $V_o$ in conjunction with positive ion space charge aids in the controllable transport of electrons through the passageway to the target means 50. The positive ion space charge within passageway portion 70 may be such that electric fields have components along line 104 forcing electrons through passageway portion 70.

In order to selectively control the passage of electrons through each passageway 58, the various electrode strips 64A, 66A and 68A along with row drivers 62A and 62B and column drivers 62C are utilized to address each picture segment of target means 50 to be exposed to a predetermined amount of electrons. Preferably the picture segments are exposed in a "line at a time" mode. Specifically, the addressing technique utilized allows for the picture elements of the same row to be exposed simultaneously during the course of the display.

Referring to FIGS. 9-11 the display is actually a matrix array of picture elements 110, for example 15 rows by 15 columns. The Picture element array corresponds to a 15×15 array of the passageways 58 of the grid control means 54. The rows are divided into a plurality of groups. For example, 15 rows can be divided into three groups of five contiguous rows each. Anode lines 46A are all commonly connected to ground via lines 87. The cathode strips 44A corresponding to each row group are commonly connected to line 74 which in turn is connected to the row group drivers 62A. Although not shown in detail drivers 62A provide appropriate negative potentials at approximately the Paschen minimum with respect to ground, to lines 74 to provide a sustained discharge. In addition the conductive strips 64A and 66A that form the passageway portion 70 and correspond to a single row are connected together and to lines 104 such that the strips 64A and 66A corresponding to the same ordered row of each row group are commonly connected together. Each line 104 is in turn connected to row drivers 62B. By way of example, if the rows of each group are labeled 1 through 5, the strips 64A and 66A that correspond to rows labeled 1 are all commonly connected to a line 104A; the strips 64A and 66A that correspond to rows labeled 2 are all commonly connected to a different line 104B and so on. There are, then in this example, five lines 104. If a particular row is to be energized the corresponding row group drivers 62A provides the appropriate potential to sustain a discharge between the anode and cathode strips 44A and 46A corresponding to that row, thereby providing a source of electrons to the appropriate row group. Similarly the corresponding row driver 62B provides the appropriate potential such that electron current may be drawn to the entrances of the appropriate passageway portion 70. Finally, the strips 68A which have a control function similar to the thyratron grids are individually connected to lines 88, which in turn are individually connected to column drivers 62C. In the example, if there are 15 columns there will be 15 column drivers. The appropriate potentials may then be provided by column drivers 62C to individually and simultaneously control the picture elements of the selected row.

As is well known in the art, a signal coded with information for the display, derived from video signal processor 116, is fed into decoders 112A, 112B and 112C which in turn provides the appropriate signals over lines 114A, 114B and 114C to the respective drivers 62A, 62B and 62C to provide the display.

Where a particular picture segment is to be exposed the appropriate signal is provided to decoder 112A, which in turn provides a signal over line 114A to drivers 62A so that the appropriate cathode strips 44A of the particular row group addressed are provided with a potential in order to provide a discharge between the anode and cathode strips of that group. The portion of the signal decoded by decoder 112B will energize the particular driver of drivers 62B so that the appropriate potential is provided on the electrode strips 64A and 66A for the appropriate row of each row group. Finally, the portion of the signal decoded by decoder 112C will energize the drivers 62C corresponding to the particular column to be energized. It will be appreciated that for the particular picture segment to be exposed to electrons the drivers 62A, 62B and 62C must all provide the appropriate signals, and that the technique enables each and every segment to be independently addressed.

Referring to FIG. 9, each cathode strip 44A, anode strip 46A and electrode strips 64A, 66A and 68A may be connected to an isolating impedance, and more specifically resistance 116 in order to provide greater uniformity and stability in the sustained gas discharge. This obviates the need for structures whose function is equivalent to Watanabe's "subsidiary electrode".

Figure 12:
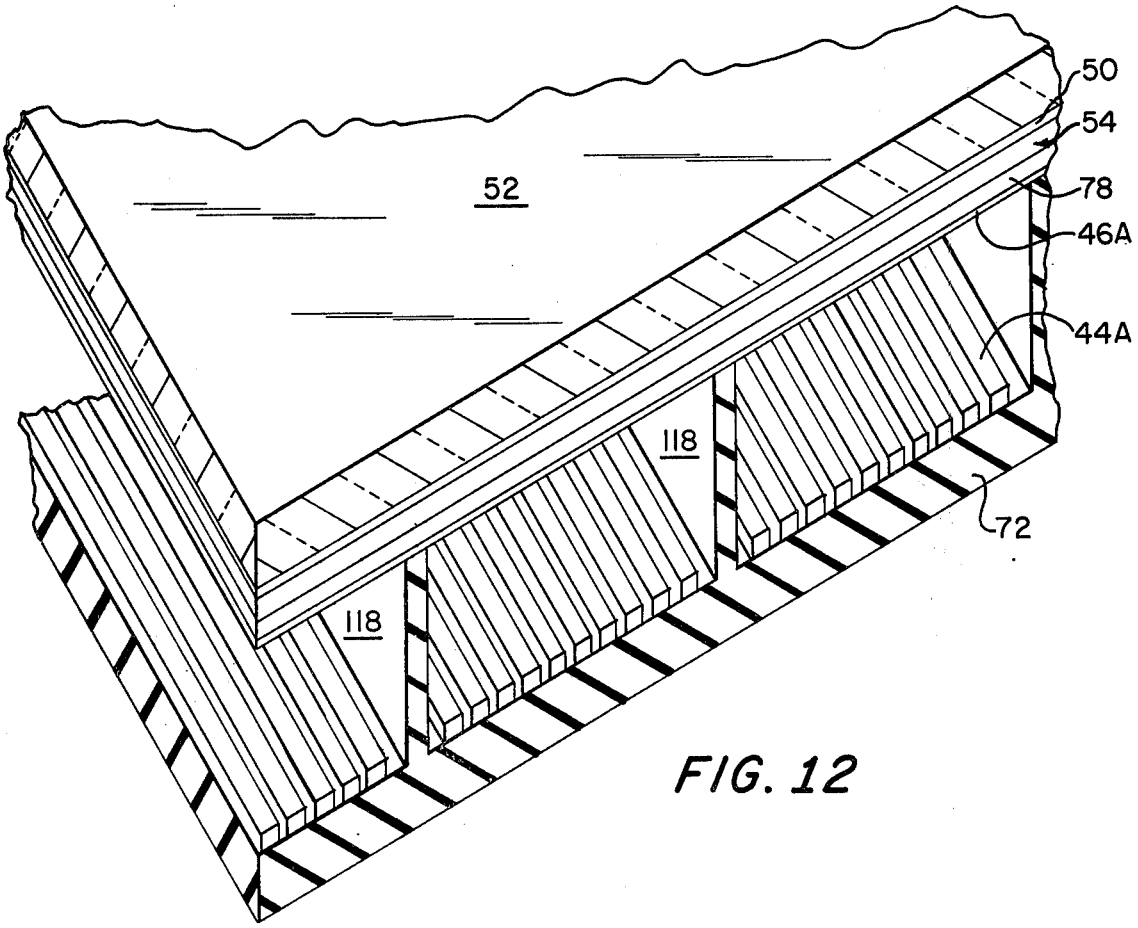
FIG. 12 is a perspective view of a modification to the present invention.

Although the invention has been described in its preferred form it will be appreciated that various modifications can be made without departing from the scope of the invention. For example, referring to FIG. 12, a partition 118, made of an insulating material, and extending from the cathode insulating sheet 72 to the insulating sheet 78 across the width of the panel can be utilized to provide structural supports as well as isolate the sustained discharge spaces between the cathode strips 44A and anode strips 46A corresponding to each row group so that a sustained discharge with respect to one group will not effect another.

Although the means for limiting the positive ion space charge formation is described in the preferred embodiment as the passageway portion 70 having its inner surfaces including the conductive strips 64A and 66A set at the potential $V_o$, the means for limiting such ion formation may take other forms. For example, the strips 64A and 66A do not necessarily have to be set at the same potential $V_o$, but can be set at different potentials. Further, although the passageway portion and the electron path therethrough connects to offsetting but parallel axes along which the electrons travel, the passageway need only be long and narrow and may include conductive surfaces or may include only nonconductive surfaces for limiting positive ion space charge formation. Thus, the path of the electrons can be along an offset path as in the embodiment shown in FIGS. 9 and 10 as well as FIG. 17 or it can be along a straight line path as shown in FIGS. 13 - 16.

Figure 13:
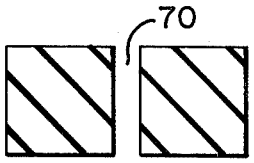
FIGS. 13–16 are each a simplified cross-sectional view of a grid control electrode incorporating a modification to the positive ion sheath limiting means of the present invention.

As shown in FIG. 13, the passageway is essentially straight and narrow and is defined by electrically-insulative wall surfaces.

Figure 14:
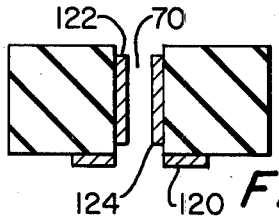
Figure 15:
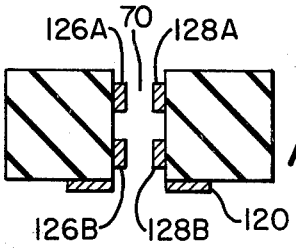
Figure 16:
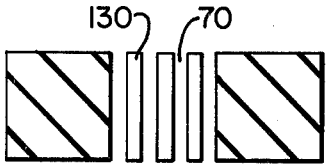
Figure 17:
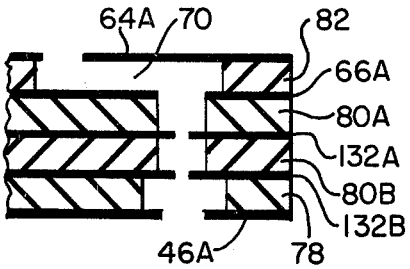
FIG. 17 is a cross-sectional view illustrating a modification to the addressing means associated with the embodiment of FIG. 8.

As shown in FIGS. 14 and 17, various electrodes may be disposed within and about the passageway portion 70 and held at various potentials by suitable means to control electron transport processes. In FIG. 14 the conductive surfaces 122 and 124 are disposed diametrically opposite one another within the passageway portion 70, and are held at a potential substantially negative with respect to the potential on the electrode structure 120 at the entrance of the portion 70. In FIG. 15, various electrodes are placed in passageway portion 70 to attract and neutralize positive ions. More specifically, electrodes 126A and 126B, axially spaced from one another, are held at a substantially negative potential with respect to the corresponding diametrically opposite positioned electrodes 128A and 128B so as to sweep electrons to one side of the passageway and positive ions to the other side of selectively inhibit electron transport. In addition as in FIG. 16 various physical obstructions 130 may be disposed within the passageway. Obstructions 130 may have either electrically conductive or insulative surfaces to limit positive ion formation by surface proximity.

It will be appreciated that other means for controlling electron flow through each passageway can be utilized. For example, as shown in FIG. 17, the device shown is identical to the device shown in FIGS. 9 and 10, except that each of the strips 68A, associated with the thyratron type control is replaced with two (or more) spaced-apart electrode strips 132A and 132B spaced from one another by an additional electrically insulative sheet 80B. By utilizing two (or more) electrode strips 132; the number of column drivers can be substantially reduced by utilizing any one of several addressing techniques well known in the art.

Further, modifications include segmenting the continuous sheet corresponding to the high voltage anode and cathodoluminescent screen into electrically separate strips each strip corresponding to a column or columns of the display. These strips may be connected together through individual isolating impedances, one impedance corresponding to one strip, to the high voltage power supply 60. This modification may attribute to stability and control at higher electron currents to each image segment in "line at a time" mode of image display. Additionally, all of the conductive surfaces and in particular those in the passageway can be made of a material, e.g., nickel, graphite, or tungsten that are capable of sustaining some positive ion bombardment.

In addition any other means for spacing the conductive strips 64A from the target means 50 may be substituted for the insulative sheet 84.

The above described gas discharge device has several advantages. First by operating at a pressure P and discharge path d between the cathode means and anode means, so that the product pd allows the striking voltage to equal the Paschen minimum, the invention provides for efficient energy consumption and ease of device construction. Further by providing the discharge between the cathode means 44 and anode means 46 in a direction of the depth dimension of the panel, (i.e., toward the high voltage anode 50) with the relatively small value d, the panel can be made relatively thin. Additionally, by utilizing the addressing techniques shown and described, even greater energy consumption efficiency and device simplicity is achieved.

Since certain changes may be made in the above apparatus without departing from the scope of the invention herein involved, it is intended that all matter contained in the above description or shown in the accompanying drawing shall be interpreted in an illustrative and not in a limiting sense.

What is claimed is:

1. A plasma discharge display assembly comprising in combination:

a sealed enclosure;

a gas disposed in said enclosure at a predetermined pressure P;

cathode means disposed in said enclosure for generating electrons;

cathodoluminescent target means, disposed within said enclosure and spaced from said cathode means, said target means generating light in response to electrons striking said target means;

electrode means disposed between said cathode means and target means and including at least one passageway for conducting electrons between said cathode means and said target means, said electrode means further including anode means disposed at a distance d from said cathode means, for maintaining a selfsustained discharge from said cathode means to said anode means, control means for selectively controlling the conduction of electrons through said passageway, and means for limiting substantial positive ion space charge within said passageway;

wherein electron mean free path through said passageway is such that substantial positive ion space charge can form within said passageway and the product Pd is that product where a self-sustained plasma discharge occurs between said cathode means and said anode means when the electrical potential between the cathode means and anode means is substantially equal to the Paschen-minimum voltage of said gas.

2. A display assembly according to claim 1, wherein said passageway defines a straightline path for said electrons from said cathode means to said target means.

3. A display assembly according to claim 1, wherein said passageway defines a path for said electrons which includes a connecting portion connecting offset parts of said path.

4. A display assembly according to claim 3, wherein said means for limiting positive ion space charge formation is disposed within said connecting portion.

5. A display assembly according to claim 3, wherein said means for limiting positive ion space charge formation includes electrically conductive surfaces disposed within said connecting portion.

6. A display assembly according to claim 1, wherein said means for limiting positive ion space charge formation includes at least one obstruction disposed within said passageway.

7. A display assembly according to claim 6, wherein said obstruction includes an electrically conductive surface.

8. A display assembly according to claim 6, wherein said obstruction includes an electrically insulative surface.

9. A display assembly according to claim 1, wherein said means for limiting positive ion space charge formation includes at least two electrodes disposed along the surface of said passageway and further including means for imposing a potential on said electrodes relative to the potential at the entrance to said passageway.

10. A display assembly according to claim 1, wherein said electrode means includes a plurality of passageways arranged in a row and column array, and said assembly includes addressing means for selectively applying control signals to the means for selectively controlling the conduction of electrons through each of said passageways.

11. A display assembly according to claim 1, wherein said addressing means includes means for addressing said electron conduction control means in a line at a time mode.

12. A display assembly according to claim 1, wherein said electron conduction control means for each of said passageways includes electrode means for providing thyratron grid control of electron flow through said passageways.

13. A display assembly according to claim 1, wherein said cathode means and said anode means that provides the sustained discharge are disposed such that the sustained discharge occurs in a direction substantially perpendicular to the plane of the target means.

14. In a plasma discharge display assembly of the type comprising a sealed enclosure, a gas disposed in said enclosure at a predetermined pressure P;

means for providing a self-sustained plasma discharge, cathodoluminescent target means, disposed within said enclosure and spaced from said self-sustained discharge, electrode means disposed between said means for providing said self-sustained discharge and said target means and including at least one passageway for conducting electrons between said means for providing said self-sustained discharge and said target means and means for controlling the transport of electrons through said passageway, wherein the improvement comprises:

means, disposed within said passageway, for forcing electrons from said self-sustained discharge, through said passageway to said target means when the electron means free path of electrons transported through said passageway is such that substantial positive ion space charge can form within said passageway.

15. A display assembly according to claim 14, wherein said means for forcing electrons includes means for limiting the formation of said positive ion space charge within said passageway.

16. In a plasma discharge display assembly of the type comprising a sealed enclosure, a gas disposed in said enclosure at a predetermined pressure P; means disposed in said enclosure for providing a self-sustained gas discharge; cathodoluminescent target means disposed within said enclosure and spaced from said self-sustained discharge, electrode means disposed between said means for providing self-sustained discharge and said target means and including at least one passageway for conducting electrons from said means for providing said self-sustained discharge to said target means; control means for selectively controlling the conduction of electrons through said passageway; the improvement comprising;

means for limiting substantial positive ion space charge within said passageway when said pressure P is such that substantial positive ion space charge can otherwise flow within said passageway.

17. A display assembly according to claim 16 wherein the electron means free path length at said pressure P is such that substantial positive ion space charge can otherwise form within said passageway.

18. A display assembly according to claim 16 wherein said electrode means is spaced from said cathodoluminescent target means such that a self-sustained discharge therebetween cannot occur.

19. A display assembly according to claim 16 wherein said cathodoluminescent target means includes a high voltage cathodoluminescent target.

20. A display assembly according to claim 16 wherein said means for providing a self-sustained gas discharge includes anode means and cathode means spaced from said anode means by a distance d such that the product Pd is that product where a self-sustained discharge occurs when an applied relative potential between said anode means and cathode means substantially equals the Paschen minimum potential.

21. A display assembly according to claim 16 wherein said means for providing self-sustained gas discharge is such that the self-sustained gas discharge occurs in a direction substantially perpendicular to the plane of said target means.

22. A display assembly according to claim 16 wherein said means for limiting substantial positive ion space charge includes a passageway portion that is relatively long and narrow.

23. A display assembly according to claim 16 wherein said means for limiting substantial positive ion space charge includes electrically conductive surfaces disposed within said passageway.

24. A display assembly according to claim 23, further including means for applying to said electrically conductive surfaces relative potentials substantially below that of said cathodoluminescent target means.

25. A display assembly according to claim 16 wherein said passageway defines a straight line path from said means for providing a self-sustained gas discharge to said target means.

26. A display assembly according to claim 16 wherein said passageway defines a path which includes a connecting portion connecting offset parts of said path.

27. A display assembly according to claim 26 wherein said means for limiting substantial positive ion space charge is disposed within said connecting portion.

28. A display assembly according to claim 27 wherein said means for limiting substantial positive ion space charge includes electrically conductive surfaces disposed within said connecting portion.

29. A display according to claim 16 wherein said means for limiting positive ion space charge comprises at least one electrode disposed in said passageway.

30. A display according to claim 16 wherein said electrode means includes a plurality of passageways arranged in a row and column array, said assembly further comprising addressing means for selectively applying control signals to said means for selectively controlling the conduction of electrons through each of said passageways.

31. A display assembly according to claim 30 wherein said addressing means includes means for addressing said means for selectively controlling the conduction of electrons through each of said passageways in a line at a time mode.

32. A display assembly according to claim 16 wherein said sealed enclosure is substantially in the shape of a flat panel.

33. A display assembly according to claim 16 wherein said means for controlling the electrons through each of said passageways includes electrode means for providing thyratron grid control of electron flow through said passageways.

34. A display assembly according to claim 16, wherein said electron means for providing thyratron grid control is spaced from said target means by a predetermined distance D, and the product PD is below the Paschen minimum so that a self-sustained discharge between said electron means and said target means will not occur when a relatively high potential difference is applied therebetween.

35. The display assembly according to claim 34, wherein said cathodoluminescent target means includes a high voltage cathodoluminescent target.

36. A display assembly according to claim 35 wherein said means for limiting substantial positive ion space charge within said passageway includes at least one obstruction disposed within said passageway.

37. A display assembly according to claim 36, wherein said obstruction includes an electrically conductive surface.

38. A display assembly according to claim 36, wherein said obstruction includes an electrically insulative surface.

39. A display assembly according to claim 35, wherein said means for providing a self-sustained gas discharge includes anode means and cathode means spaced from said anode means by a distance d such that the product Pd is that product where a self-sustained discharge occurs when an applied relative potential between said anode means and cathode means substantially equals the Paschen minimum potential.

40. A display assembly according to claim 39, wherein said means for providing said self-sustained gas discharge is such that the self-sustained gas discharge occurs in a direction substantially perpendicular to the plane of said target means.

41. A display assembly according to claim 40, wherein said sealed enclosure is substantially in the shape of a flat panel and wherein said electron means includes a plurality of passageways arranged in a row and column array, said assembly further comprising addressing means for selectively applying control signals to said means for selectively controlling the conduction of electrons through each of said passageways.

42. A display assembly according to claim 35, wherein said means for providing said self-sustained gas discharge is such that the self-sustained gas discharge occurs in a direction substantially perpendicular to the plane of said target means.

43. A display assembly according to claim 35, wherein said electrode means includes a plurality of passageways arranged in a row and column array, said assembly further comprising addressing means for selectively applying control signals to said means for selectively controlling the conduction of electrons through each of said passageways.

44. A display assembly according to claim 43, wherein said means for providing self-sustained gas discharge includes anode means and cathode means spaced from said anode means by a distance d such that the product Pd is that product where a self-sustained discharge occurs when an applied relative potential between said anode means and cathode means substantially equals the Paschen minimum potential.

45. A display assembly according to claim 43, wherein said means for providing said self-sustained gas discharge is such that the self-sustained gas discharge occurs in a direction substantially perpendicular to the plane of said target means.

46. A display assembly according to claim 35, wherein said sealed enclosure is substantially in the shape of a flat panel.

47. A display assembly according to claim 46, wherein said electrode means includes a plurality of passageways arranged in a row and column array, said assembly further comprising addressing means for selectively applying control signals to said means for selectively controlling the conduction of electrons through each of said passageways.

48. A display assembly according to claim 47, wherein said means for limiting substantial positive ion space charge within said passageway includes at least one obstruction disposed within said passageway.

49. A display assembly according to claim 46, wherein said means for providing a self-sustained gas discharge includes anode means and cathode means spaced from said anode means by a distance d such that the product Pd is that product where a self-sustained discharge occurs when an applied relative potential between said anode means and cathode means substantially equals the Paschen minimum potential.

50. A display assembly according to claim 46, wherein said means for providing said self-sustained gas discharge is such that the self-sustained gas discharge occurs in a direction substantially perpendicular to the plane of said target means.

* * * * *

UNITED STATES PATENT AND TRADEMARK OFFICE

CERTIFICATE OF CORRECTION

PATENT NO. : 4,160,191

DATED : July 3, 1979

INVENTOR(S) : A. David Hausfeld

It is certified that error appears in the above-identified patent and that said Letters Patent are hereby corrected as shown below:

Claim 34, line 39, delete "electron" and substitute therefor --electrode--;

Claim 34, line 39, delete "for providing thyratron";

Claim 34, line 40, delete "grid control";

Claim 34, line 43, delete "electron" and substitute therefor --electrode--;

Claim 41, line 8, delete "electron" and substitute therefor --electrode--;

Claim 44, line 27, after "providing" insert --a--;

Signed and Sealed this

Ninth Day of October 1979

[SEAL]

*Attest:*

RUTH C. MASON
*Attesting Officer*

LUTRELLE F. PARKER
*Acting Commissioner of Patents and Trademarks*